US009161134B2

(12) United States Patent
Inagaki

(10) Patent No.: US 9,161,134 B2
(45) Date of Patent: Oct. 13, 2015

(54) ACOUSTIC GENERATOR, ACOUSTIC GENERATING DEVICE, AND ELECTRONIC DEVICE

(71) Applicant: KYOCERA Corporation, Kyoto-shi, Kyoto (JP)

(72) Inventor: Masahiro Inagaki, Kizugawa (JP)

(73) Assignee: KYOCERA CORPORATION, Kyoto-Shi, Kyoto (JP)

( * ) Notice: Subject to any disclaimer, the term of this patent is extended or adjusted under 35 U.S.C. 154(b) by 0 days.

(21) Appl. No.: 14/380,182

(22) PCT Filed: Sep. 26, 2013

(86) PCT No.: PCT/JP2013/076098

§ 371 (c)(1),
(2) Date: Aug. 21, 2014

(87) PCT Pub. No.: WO2014/050983

PCT Pub. Date: Apr. 3, 2014

(65) Prior Publication Data

US 2015/0016640 A1 Jan. 15, 2015

(30) Foreign Application Priority Data

Sep. 26, 2012 (JP) ..... 2012-212764

(51) Int. Cl.

| | |
|---|---|
| ***H04R 17/00*** | (2006.01) |
| ***H04R 9/02*** | (2006.01) |
| ***H04R 1/28*** | (2006.01) |
| *H04R 7/26* | (2006.01) |
| *H04R 9/06* | (2006.01) |
| *H04R 13/00* | (2006.01) |

(52) U.S. Cl.

CPC .. *H04R 9/02* (2013.01); *H04R 1/28* (2013.01); *H04R 1/288* (2013.01); *H04R 17/00* (2013.01); *H04R 7/26* (2013.01); *H04R 9/06* (2013.01); *H04R 13/00* (2013.01); *H04R 2499/11* (2013.01); *H04R 2499/15* (2013.01)

(58) Field of Classification Search

CPC ..... H04R 17/00; H04R 17/10; H04R 1/28; H04R 1/2803; H04R 7/26; H04R 19/00

USPC ..... 381/190, 191, 396, 413

See application file for complete search history.

(56) References Cited

U.S. PATENT DOCUMENTS

| | | | | |
|---|---|---|---|---|
| 4,597,099 | A * | 6/1986 | Sawafuji | 381/190 |
| 2013/0094681 | A1 | 4/2013 | Fukuoka et al. | |

FOREIGN PATENT DOCUMENTS

| | | | |
|---|---|---|---|
| JP | 2004-023436 | A | 1/2004 |
| JP | 2006-332861 | * | 12/2006 |
| JP | 2006-332861 | A | 12/2006 |
| JP | 2012-110018 | A | 6/2012 |
| WO | WO2011/162002 | * | 12/2011 |

OTHER PUBLICATIONS

International Search Report, PCT/JP2013/076098, Nov. 25, 2013, 1 pg.

* cited by examiner

*Primary Examiner* — Ahmad F Matar
*Assistant Examiner* — Sabrina Diaz
(74) *Attorney, Agent, or Firm* — Volpe and Koenig, P.C.

(57) ABSTRACT

An acoustic generator according to an aspect of an embodiment includes an exciter, a vibrating body, and a damping member. The exciter receives input of an electric signal and vibrates. The exciter is attached to the vibrating body, and the vibrating body vibrates together with the exciter with vibration of the exciter. The damping member is attached so as to vibrate together with the vibrating body and the exciter and has a non-uniform thickness in a direction orthogonal to a vibration surface of the vibrating body.

10 Claims, 8 Drawing Sheets

ACOUSTIC GENERATOR, ACOUSTIC GENERATING DEVICE, AND ELECTRONIC DEVICE

FIELD OF INVENTION

Disclosed embodiments relate to an acoustic generator, an acoustic generating device, and an electronic device.

BACKGROUND

Conventionally, acoustic generators that use a piezoelectric element have been known (for example, see Patent Literature 1). The acoustic generators vibrate a vibration plate by applying a voltage to the piezoelectric element attached to the vibration plate and vibrating the piezoelectric element, and output sound by using resonance of the vibration positively.

The acoustic generators can use a thin film such as a resin film for the vibration plate. This enables the acoustic generators to be reduced in thickness and weight in comparison with common electromagnetic speakers and the like.

When the thin film is used for the vibration plate, the thin film is required to be supported in an evenly tensioned state by being held between a pair of frame members in the thickness direction, for example, in order to obtain excellent acoustic transduction efficiency.

CITATION LIST

Patent Literature

Patent Literature 1: Japanese Patent Application Laid-open No. 2004-023436

SUMMARY

An acoustic generator according to an aspect of embodiments includes an exciter, a vibrating body, and a damping member. The exciter receives input of an electric signal and vibrates. The vibrating body to which the exciter is attached and that vibrates together with the exciter with vibration of the exciter. The damping member that is attached so as to vibrate together with the vibrating body and the exciter and has a non-uniform thickness in a direction orthogonal to a vibration surface of the vibrating body.

An acoustic generating device according to an aspect of embodiments includes the acoustic generator above, and a housing that accommodates the sound generator.

An electronic device according to an aspect of embodiments includes the acoustic generator above, an electronic circuit that is connected to the acoustic generator, and an electronic circuit that is connected to the acoustic generator, and a case that accommodates the electronic circuit and the acoustic generator. The electronic device has a function of generating sound from the acoustic generator.

DETAILED DESCRIPTION OF THE PREFERRED EMBODIMENTS

Hereinafter, embodiments of an acoustic generator, an acoustic generating device, and an electronic device that are disclosed by the present application are described in detail with reference to the accompanying drawings. The embodiments, which will be described below, do not limit the disclosure.

Figure 1A:
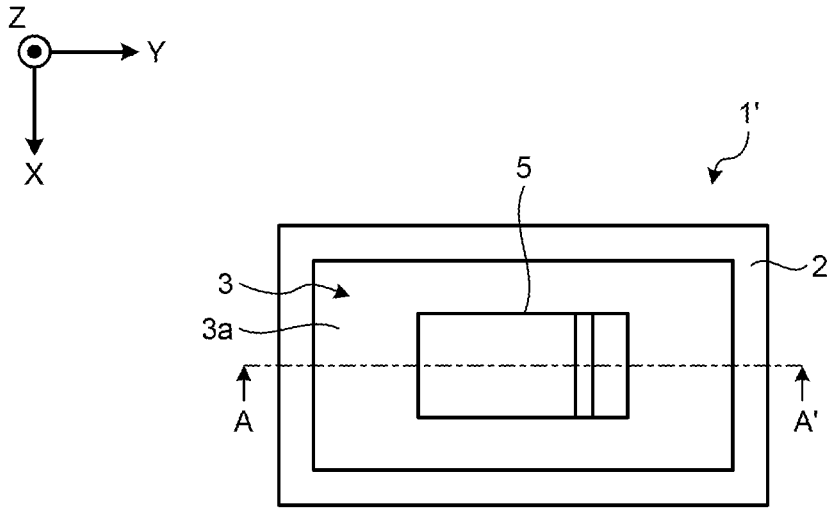
FIG. 1A is a schematic plan view illustrating the schematic configuration of a basic acoustic generator.

First, the schematic configuration of a basic acoustic generator 1' is described with reference to FIG. 1A and FIG. 1B before an acoustic generator 1 in the embodiment is described. FIG. 1A is a schematic plan view illustrating the schematic configuration of the acoustic generator 1' and FIG. 1B is a cross-sectional view cut along line A-A' in FIG. 1A.

Figure 1B:
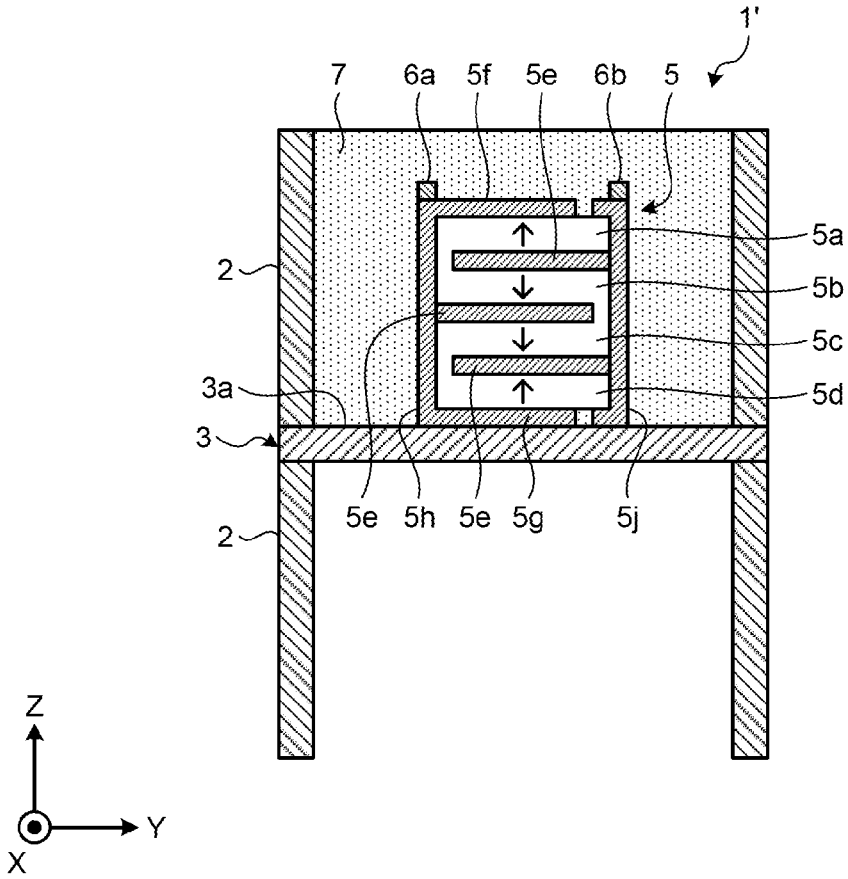
FIG. 1B is a cross-sectional view cut along line A-A' in FIG. 1A.

For easy understanding of the explanation, FIG. 1A and FIG. 1B illustrate a three-dimensional orthogonal coordinate system including a Z axis along which upward vertical direction is set to a positive direction and downward vertical direction is set to a negative direction. The orthogonal coordinate system is also illustrated in other drawings that are used for description later in some cases.

Hereinafter, as for a constituent component constituted by a plurality of components, a reference numeral denotes some of the components only and does not denote others of them in some cases. In such a case, some of the components designated with the reference numeral and others of them have the same configuration.

In FIG. 1A, illustration of a resin layer 7 (which will be described later) is omitted. FIG. 1B illustrates the acoustic generator 1' in the thickness direction (Z-axis direction) in an enlarged and magnified manner for easy understanding of the explanation.

As illustrated in FIG. 1A, the acoustic generator 1' includes a frame body 2, a vibration plate 3, and a piezoelectric element 5 that is an example of an exciter.

The frame body 2 is constituted by two frame members having rectangular frame-like shapes that are the same. The frame body 2 functions as a support member supporting the vibration plate 3 by holding the peripheral edge portion of the vibration plate 3 between the two frame members. The vibration plate 3 has a plate-like shape or a film-like shape. The peripheral edge portion of the vibration plate 3 is fixed by being held between the two frame members constituting the frame body 2, so that the vibration plate 3 is supported substantially flat in a state of being tensioned evenly in a frame of the frame body 2.

A portion of the vibration plate 3 at the inner side relative to the inner circumference of the frame body 2, that is, a portion of the vibration plate 3 that is not held between the frame members of the frame body 2 and can vibrate freely is assumed to be a vibrating body 3*a*. That is to say, the vibrating body 3*a* corresponds to a portion having a substantially rectangular shape in the frame of the frame body 2.

The vibration plate 3 can be made of various materials such as a resin and a metal. For example, the vibration plate 3 can be formed by a resin film made of polyethylene, polyimide, or the like that has the thickness of 10 to 200 μm.

The thickness, the material, and the like of the two frame members constituting the frame body 2 are not particularly limited and can be made of various materials such as a metal and a resin. For example, the two frame members constituting the frame body 2 that are made of stainless steel or the like having the thickness of 100 to 5000 μm can be preferably used from a viewpoint that it is excellent in mechanical strength and corrosion resistance.

While FIG. 1A illustrates the frame body 2 of which the inner region has a substantially rectangular shape, the inner region of the frame body 2 may have a polygonal shape such as a parallelogram shape, a trapezoidal shape, and an n-sided regular polygonal shape. In the present embodiment, the inner region of the frame body 2 has a substantially rectangular shape, as illustrated in FIG. 1A.

Although the frame body 2 is constituted by the two frame members and supports the vibration plate 3 by holding the peripheral edge portion of the vibration plate 3 between the two frame members in the above-mentioned description, the embodiment is not limited thereto. For example, the frame body 2 may be constituted by one frame member and support the vibration plate 3 by attaching and fixing the peripheral edge portion of the vibration plate 3 to the frame body 2.

The piezoelectric element 5 is an exciter that is provided by being bonded to the surface of the vibrating body 3*a*, for example, and excites the vibrating body 3*a* by receiving application of a voltage and vibrating.

As illustrated in FIG. 1B, the piezoelectric element 5 includes piezoelectric layers 5*a*, 5*b*, 5*c*, and 5*d*, a laminate body, surface electrode layers 5*f* and 5*g*, and external electrodes 5*h* and 5*j*. The piezoelectric layers 5*a*, 5*b*, 5*c*, and 5*d* are formed by four-layered ceramics. The laminate body is formed by alternately laminating three internal electrode layers 5*e*. The surface electrode layers 5*f* and 5*g* are formed on the upper surface and the lower surface, respectively, of the laminate body. The external electrodes 5*h* and 5*j* are formed on the side surfaces to which the internal electrode layers 5*e* are exposed. Furthermore, lead terminals 6*a* and 6*b* are connected to the external electrode 5*h* and 5*j*, respectively.

The piezoelectric element 5 has a plate-like shape and the main surfaces at the upper surface side and the lower surface side thereof have polygonal shapes such as an oblong shape and a square shape. The piezoelectric layers 5*a*, 5*b*, 5*c*, and 5*d* are polarized as indicated by arrows in FIG. 1B. That is to say, they are polarized such that the polarization directions at one side and at the other side in the thickness direction (Z-axis direction in FIG. 1B) with respect to the direction of an electric field applied at one moment are inverted.

When a voltage is applied to the piezoelectric element 5 through the lead terminals 6*a* and 6*b*, the piezoelectric element 5 is deformed such that the piezoelectric layers 5*c* and 5*d* at the side attached to the vibrating body 3*a* contract whereas the piezoelectric layers 5*a* and 5*b* at the upper surface side of the piezoelectric element 5 expand at one moment, for example. That is to say, by applying an alternate-current signal to the piezoelectric element 5, the piezoelectric element 5 vibrates in a bending manner so as to give bending vibration to the vibrating body 3*a*.

The main surface of the piezoelectric element 5 is bonded to the main surface of the vibrating body 3*a* with an adhesive formed by an epoxy-based resin or the like.

As a material constituting the piezoelectric layers 5*a*, 5*b*, 5*c*, and 5*d*, conventionally used piezoelectric ceramics such as lead zirconate titanate, and Bi layered compound and tungsten bronze structure compound, such as other non-lead piezoelectric substance materials, can be used.

A material of the internal electrode layers 5*e* contains a metal, for example, silver and palladium as main components. The internal electrode layers 5*e* may contain the ceramic component forming the piezoelectric layers 5*a*, 5*b*, 5*c*, and 5*d*. This can provide the piezoelectric element 5 that reduces a stress due to a thermal expansion difference between the piezoelectric layers 5*a*, 5*b*, 5*c*, and 5*d* and the internal electrode layers 5*e*.

The surface electrode layers 5*f* and 5*g* and the external electrodes 5*h* and 5*j* contain a metal, for example, silver as a main component. Furthermore, they may contain a glass component. The surface electrode layers 5*f* and 5*g* and the external electrodes 5*h* and 5*j* are made to contain the glass component so as to provide strong adhesion force between the piezoelectric layers 5*a*, 5*b*, 5*c*, and 5*d* or the internal electrode layers 5*e* and the surface electrode layers 5*f* and 5*g* or the external electrodes 5*h* and 5*j*. It is sufficient that a content of the glass component is set equal to or lower than 20% by volume.

The lead terminals 6*a* and 6*b* can be made of various metal materials. For example, when the lead terminals 6*a* and 6*b* are constituted using a flexible wiring formed by sandwiching a metal foil such as copper and aluminum between resin films, the piezoelectric element 5 can be reduced in height.

As illustrated in FIG. 1B, the acoustic generator 1' further includes the resin layer 7 that is arranged so as to cover at least a part of the surfaces of the piezoelectric element 5 and the vibrating body 3*a* in the frame of the frame body 2 and is integrated with the vibrating body 3*a* and the piezoelectric element 5. That is to say, the piezoelectric element 5 is embedded in the resin layer 7.

The resin layer 7 is preferably formed using an acrylic-based resin so as to have a Young's modulus in a range of approximately 1 MPa to 1 GPa. An adequate dumping effect can be induced by embedding the piezoelectric element 5 in the resin layer 7. This can reduce the resonance phenomenon, and the peaks and dips in the frequency characteristic of the sound pressure can be reduced to be small.

Although FIG. 1B illustrates a state where the resin layer 7 is formed so as to have a height same as that of the frame body 2, it is sufficient that the piezoelectric element 5 is embedded in the resin layer 7. For example, the resin layer 7 may be formed to be higher than the frame body 2.

Although a bimorph stacked piezoelectric element is described as the piezoelectric element 5, as an example, in FIG. 1B, the piezoelectric element 5 is not limited thereto. For example, a unimorph piezoelectric element formed by bonding the piezoelectric element 5 that expands and contracts to the vibrating body 3*a* may be used.

As illustrated in FIG. 1A and FIG. 1B, the vibrating body 3*a* is supported so as to be substantially flat in a state of being tensioned evenly in the frame of the frame body 2. In such a case, peaks and dips or distortion due to resonance induced by the vibration of the piezoelectric element 5 are generated, resulting in a drastic change in the sound pressure at specific frequencies. For this reason, the frequency characteristic of the sound pressure is difficult to be flattened.

Figure 2:
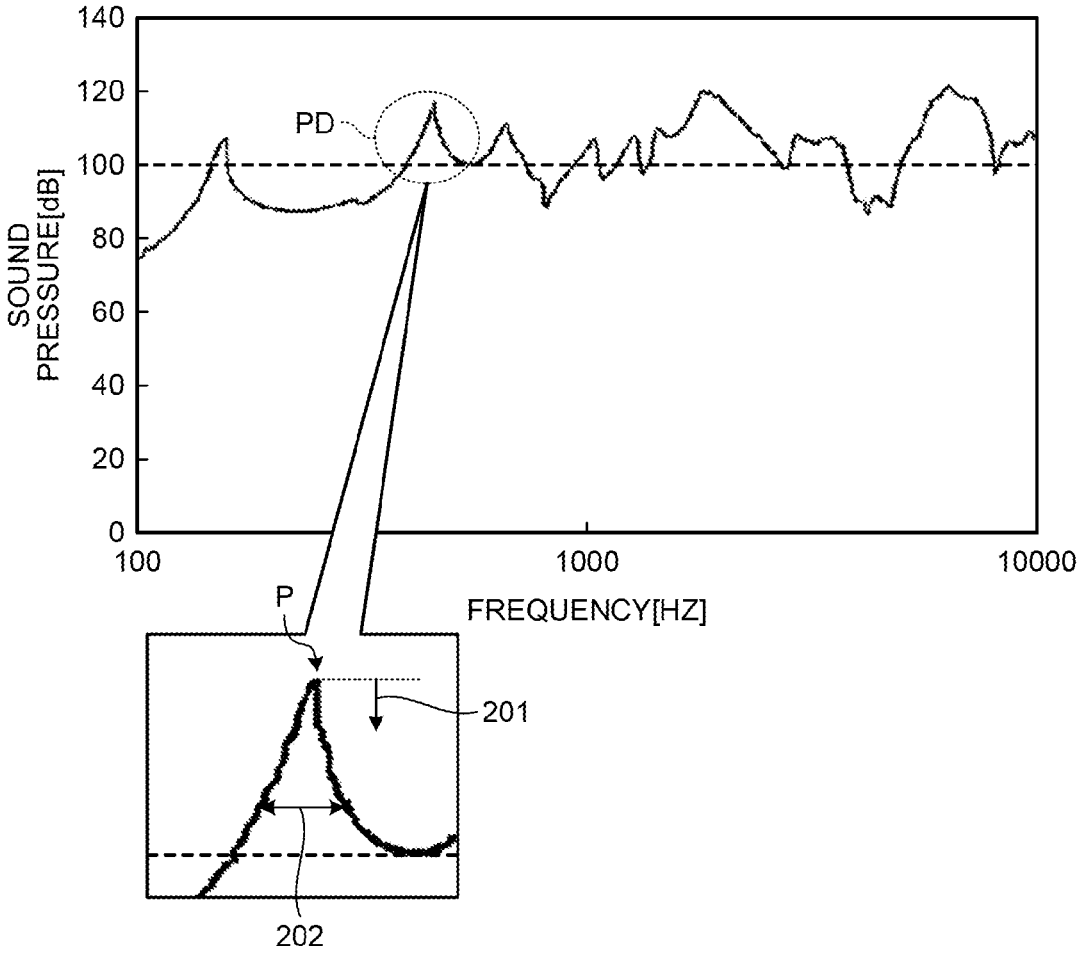
FIG. 2 is a graph illustrating an example of a frequency characteristic of a sound pressure.

This point is illustrated in FIG. 2. FIG. 2 is a graph illustrating an example of the frequency characteristic of the sound pressure. As already described above with reference to FIG. 1A, the vibrating body 3*a* is supported so as to be substantially flat in the state of being tensioned evenly in the frame of the frame body 2. This can indicate that the vibrating body 3*a* has an even Young's modulus entirely.

In such a case, the peaks are degenerated at specific frequencies in a concentrated manner due to the resonance of the vibrating body 3*a*. Due to this, as illustrated in FIG. 2, steep peaks and dips are easy to be generated in a dispersed manner over the entire frequency region.

As an example, a portion surround by a dashed closed curve PD in FIG. 2 is focused. When a peak is generated, the sound pressure is varied depending on the frequency. Due to this, preferable sound quality is difficult to be obtained.

In this case, as illustrated in FIG. 2, a measure of lowering the height of the peak P (see, arrow 201 in FIG. 2), enlarging the peak width (see, arrow 202 in FIG. 2) so as to moderate the peak P and a dip (not illustrated) is taken effectively.

In the embodiment, first, a damping member 8 (which will be described later) is attached to the surface of the resin layer 7 and vibration is damped with an internal friction loss of the damping member 8 itself so as to lower the height of the peak P.

Furthermore, in the embodiment, the thickness of the damping member 8 in the direction (Z-axis direction) orthogonal to a vibration surface (X-Y plane in FIG. 3A) of the vibrating body 3*a* is made non-uniform. That is to say, the resonance frequency is made uneven partially by making at least a part of the damping member 8 have a different thickness in the Z-axis direction. With this configuration, the degeneracy of the resonance mode is cancelled to disperse it, and the height of the peak P is lowered and the peak width is enlarged.

Figure 3A:
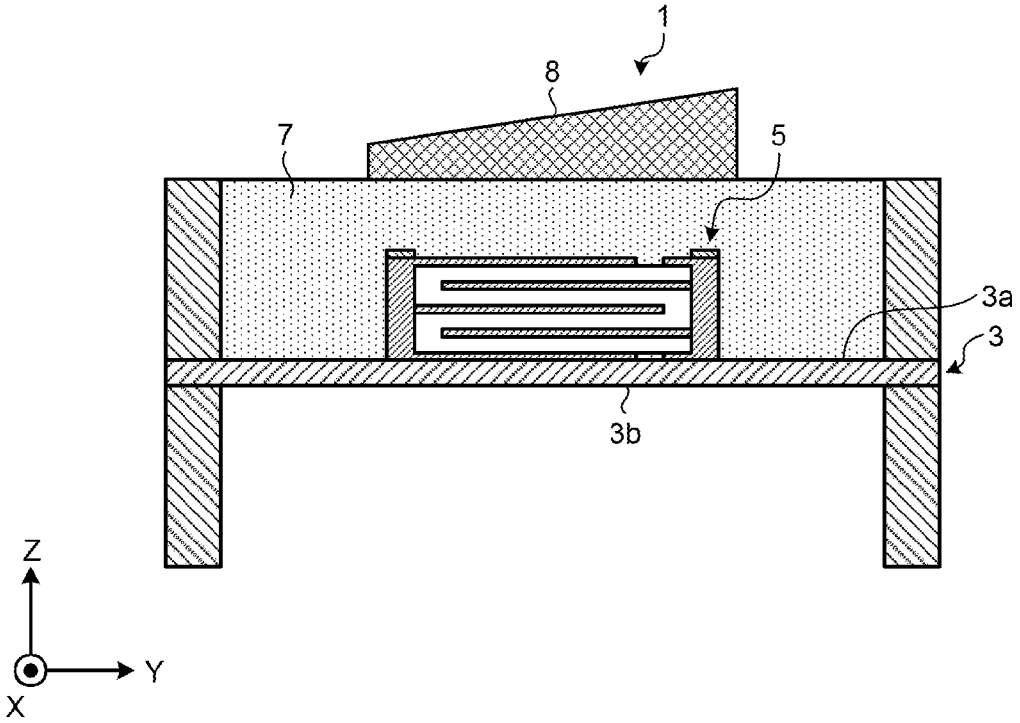
FIG. 3A is a schematic cross-sectional view illustrating the configuration of an acoustic generator according to an embodiment.
Figure 3B:
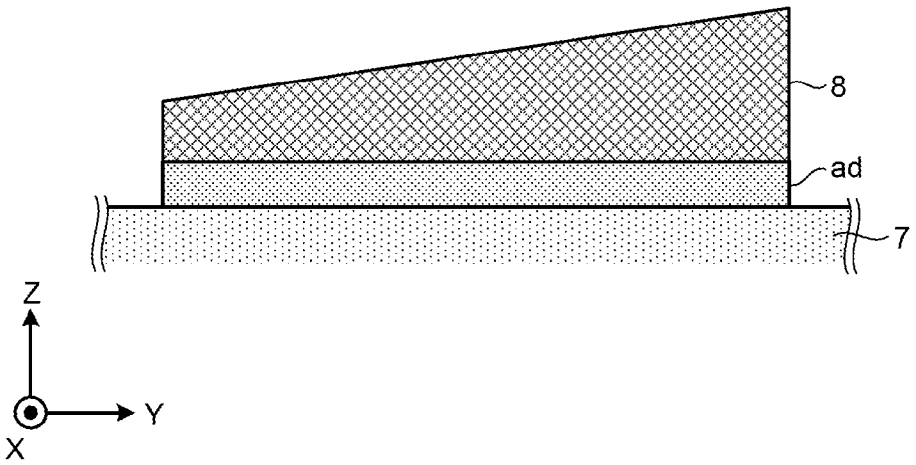
FIG. 3B is an enlarged view of FIG. 3A.

Hereinafter, the acoustic generator 1 according to the embodiment is described with reference to FIG. 3A to FIG. 10. First, FIG. 3A is a schematic cross-sectional view illustrating the configuration of the acoustic generator 1 in the embodiment. FIG. 3B is an enlarged view of FIG. 3A.

FIG. 3A and FIG. 3B illustrate the damping member 8 that is magnified in the Z-axis direction for making explanation understood easily.

As illustrated in FIG. 3A, the acoustic generator 1 includes the damping member 8 in addition to the acoustic generator 1' as illustrated in FIG. 1A and FIG. 1B.

It is sufficient that the damping member 8 has mechanical loss. The damping member 8 is desirably a member having a high mechanical loss factor, in other words, a low mechanical quality factor (what is called, mechanical Q).

The damping member 8 can be formed using an elastic material of various types, for example. Examples of a material of the damping member 8 include rubbers such as a urethane rubber, a silicone rubber, a fluoro-rubber, a chloroprene rubber, a nitrile rubber, and a natural rubber, resins such as a polyethylene resin, a vinyl chloride resin, an ABS resin, and a fluoro-resin, and polymer gels such as a polyimide gel, a polyvinylidene fluoride gel, a polymethyl methacrylate gel, a polyvinyl alcohol gel, and a polyethylene terephthalate gel. Among them, the urethane rubber that is soft, is easy to be deformed, and has stable long-term elastic deformation property is preferable because it exhibits a large damping effect. Furthermore, a material that has therein voids uniformly (uniformly in the planar direction perpendicular to the thickness direction) among the rubbers, the resins, and the polymer gels is preferable because it exhibits a larger damping effect.

For example, as illustrated in FIG. 3A, the damping member 8 is attached to the surface of the resin layer 7 and is integrated with the vibrating body 3*a*, the piezoelectric element 5, and the resin layer 7 so as to constitute a combined vibrating body that vibrates integrally.

As illustrated in FIG. 3A, in the embodiment, the damping member 8 that is formed to have the non-uniform thickness in the direction orthogonal to the vibration surface of the vibrating body 3*a* is attached to the surface of the resin layer 7. This configuration can damp the resonance frequency in accordance with the thickness thereof.

In other words, the peaks P of the sound pressure at the resonance points can be varied so as to flatten the frequency characteristic of the sound pressure. In other words, the preferable frequency characteristic of the sound pressure can be provided.

As illustrated in FIG. 3B, when the damping member 8 is attached to the resin layer 7, for example, the damping member 8 can be attached through an adhesive layer ad. As the adhesive layer ad, an epoxy resin-based two-liquid-mixed type adhesive can be used, for example.

Alternatively, the damping member 8 may be attached to the surface of the resin layer 7 directly using an adhesion force of the resin layer 7 instead of using the configuration in which the adhesive layer ad is applied. Furthermore, the damping member 8 may be formed by applying the material of the damping member 8 having fluidity onto the surface of the resin layer 7, and then, curing and/or drying it.

In the acoustic generator 1 as illustrated in FIG. 3A and FIG. 3B, the thickness of the damping member 8 in the Z-axis direction is made non-uniform by inclining it such that the thickness of an end portion of the damping member 8 at the negative side in the Y-axis direction in the Z-axis direction is smaller than that of an end portion of the damping member 8 at the positive side in the Y-axis direction. The configuration of the damping member 8 is not, however, limited thereto, and various embodiments can be applied as will be described later. The number of damping members 8 that are arranged on the acoustic generator 1 is not limited to one and a plurality of damping members 8 may be provided.

Although FIG. 3A and FIG. 3B illustrate the case where one piezoelectric element 5 is provided, this does not limit the number of piezoelectric elements 5. The following describes an arrangement example of the damping members in an acoustic generator in which two piezoelectric elements 5 are provided.

Figure 4A:
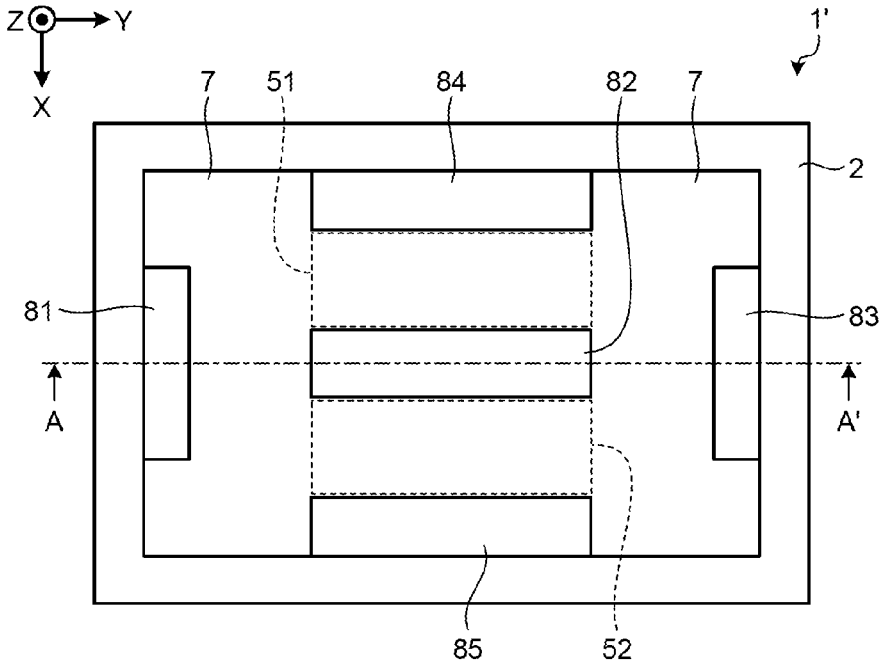
FIG. 4A is a schematic plan view illustrating an arrangement mode of damping members in the basic acoustic generator.
Figure 4B:
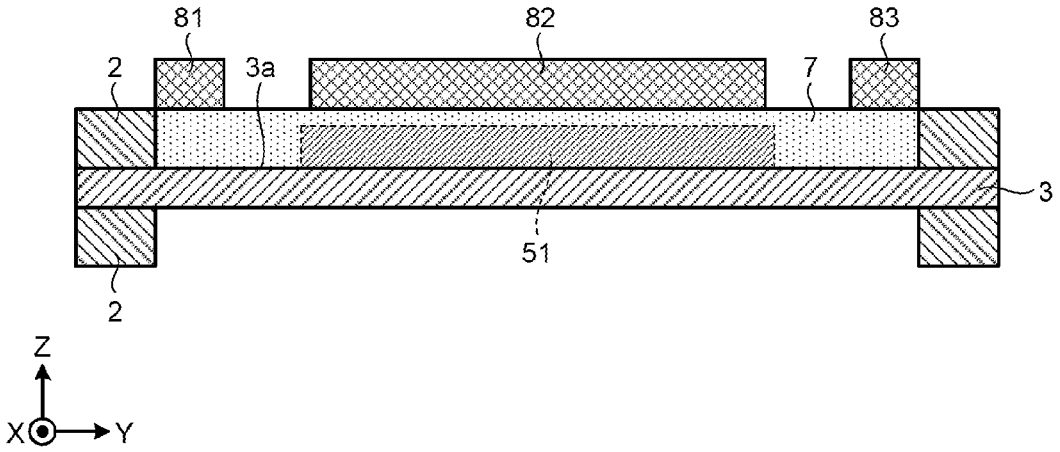
FIG. 4B is an enlarged cross-sectional view illustrating an arrangement example of the damping members in the basic acoustic generator cut along line A-A' in FIG. 4A.

FIG. 4A is a schematic plan view illustrating an arrangement mode of damping members in the basic acoustic generator 1' in which the two piezoelectric elements 5 are provided. FIG. 4B is an enlarged cross-sectional view cut along line A-A' in FIG. 4A.

In the acoustic generator 1' as illustrated in FIG. 4A, damping members 84, 82, and 85 are aligned on a center portion in the Y-axis direction so as to be along the X-axis direction. To be more specific, the damping members 84, 82, and 85 are aligned in this order at a substantially equal interval on partial regions along the contours of piezoelectric elements 51 and 52 when seen through from the above. Damping members 81, 82, and 83 are aligned on a center portion in the X-axis direction in this order at a substantially equal interval in the Y-axis direction. All of the damping members 81, 83, 84, and 85 are arranged such that the lengthwise directions thereof are along the inner sides of the frame body 2. In this manner, at least a part of the damping member 8 is preferably distributed in the vicinity of the piezoelectric element 5 or the frame body 2.

As illustrated in FIG. 4B, in the basic acoustic generator 1', the damping members 81, 82, and 83 are formed to have substantially equal thicknesses in the Z-axis direction. The damping members 84, 82, 85 as illustrated in FIG. 4A are also formed to have substantially equal thicknesses in the Z-axis direction. In contrast, in the acoustic generator as illustrated in FIG. 5 to FIG. 10, the thicknesses of the damping members in the Z-axis direction are non-uniform, thereby providing the preferable frequency characteristic of the sound pressure.

Figure 5:
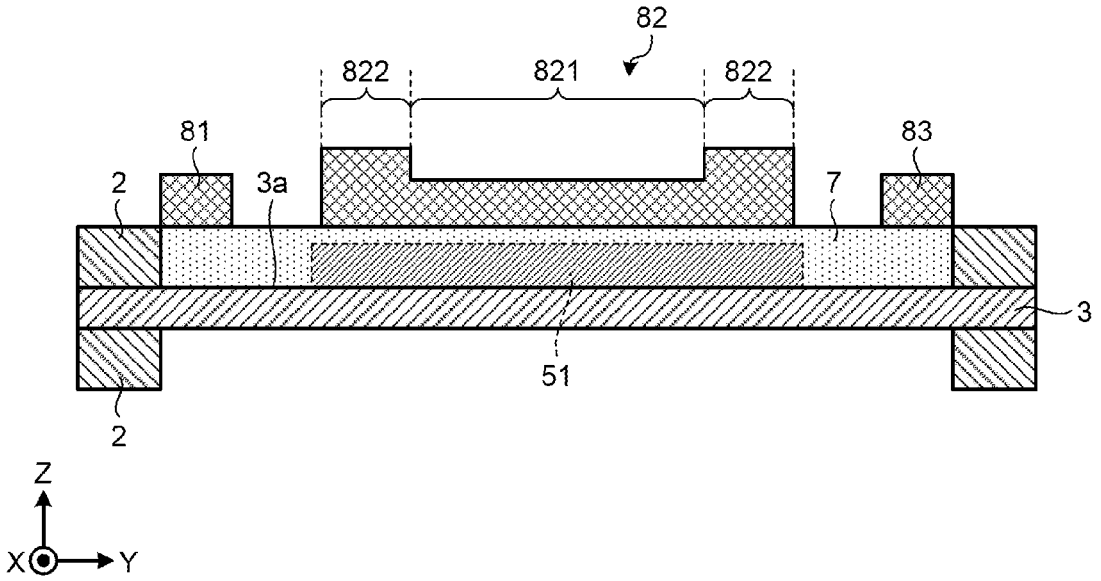
FIG. 5 is an enlarged cross-sectional view illustrating an arrangement example of damping members in the acoustic generator in the embodiment cut along line A-A' in FIG. 4A.

FIG. 5 is an enlarged cross-sectional view illustrating an arrangement example of damping members in the acoustic generator in the embodiment cut along line A-A' in FIG. 4A. In the enlarged cross-sectional views of the acoustic generator 1 including FIG. 5, which will be referred later, the shapes of the damping members are illustrated in a magnified manner for making explanation understood easily.

As illustrated in FIG. 5, the damping member 82 includes a center portion 821 serving as a first portion and outer portions 822 serving as second portions. The outer portions 822 are provided at the outer sides of the center portion 821, to be more specific, at the negative side in the Y-axis direction and at the positive side in the Y-axis direction with respect to the center portion 821. Furthermore, the center portion 821 and the outer portions 822 have different thicknesses in the Z-axis direction. Steps are formed between the center portion 821 and the outer portions 822 of which thicknesses in the Z-axis direction are larger than that of the center portion 821.

Thus, in the acoustic generator 1 in the embodiment, the damping member 82 has the center portion 821 and the outer portions 822 having different thicknesses in the Z-axis direction with the steps interposed therebetween. With this configuration, distortion that is generated with the vibration is increased on the steps, thereby enhancing the damping effect. This can reduce the difference between the resonance peaks and the dips in the frequency characteristic of the sound pressure so as to improve sound quality.

Although the damping member 82 has the steps between the outer portion 822 at the negative side in the Y-axis direction and the center portion 821 and between the center portion 821 and the outer portion 822 at the positive side in the Y-axis direction in FIG. 5, the configuration is not limited thereto. It is sufficient that a first portion having a uniform thickness and a second portion having a uniform thickness different from the thickness of the first portion are provided and at least one step is provided therebetween. With this configuration, distortion that is generated with the vibration is also increased on the step portion formed for making the thicknesses in the Z-axis direction different, thereby enhancing the damping effect. This can reduce the difference between the resonance peaks and the dips in the frequency characteristic of the sound pressure so as to improve sound quality.

Figure 6:
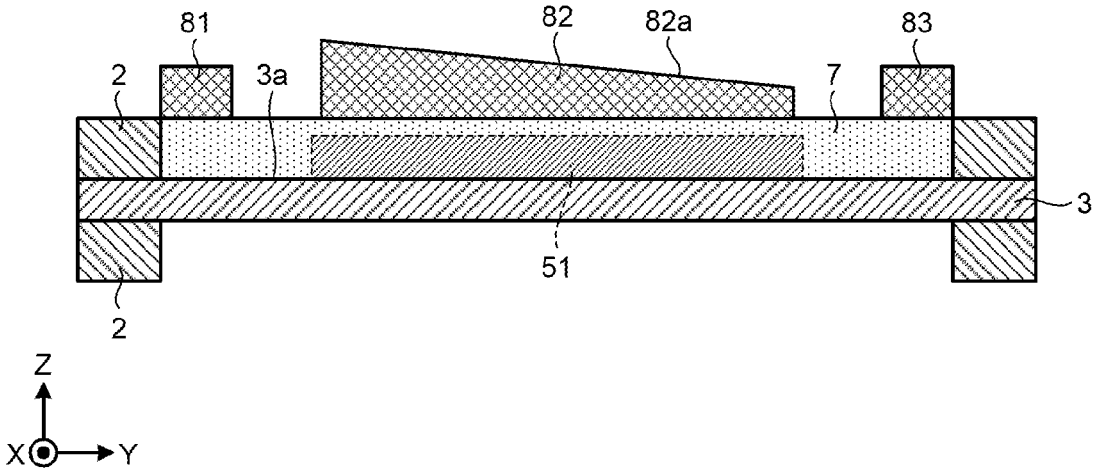
FIG. 6 is an enlarged cross-sectional view illustrating an arrangement example of other damping members in the acoustic generator in the embodiment cut along line A-A' in FIG. 4A.

FIG. 6 is an enlarged cross-sectional view illustrating an arrangement example of other damping members in the acoustic generator 1 in the embodiment cut along line A-A' in FIG. 4A.

As illustrated in FIG. 6, because the damping member 82 has an inclined surface 82*a* inclined with respect to the vibration surface of the vibrating body 3*a*, the thickness of the damping member 82 in the Z-axis direction is made non-uniform.

Thus, in the acoustic generator 1 in the embodiment, the damping member 82 includes the inclined surface 82*a* for moderately changing the thickness thereof in the Z-axis direction. The inclination of the inclined surface 82*a* causes the frequency at which the damping effect is the largest to vary, thereby enhancing the damping effect. This can reduce the difference between the resonance peaks and the dips in the frequency characteristic of the sound pressure so as to improve sound quality.

Figure 7:
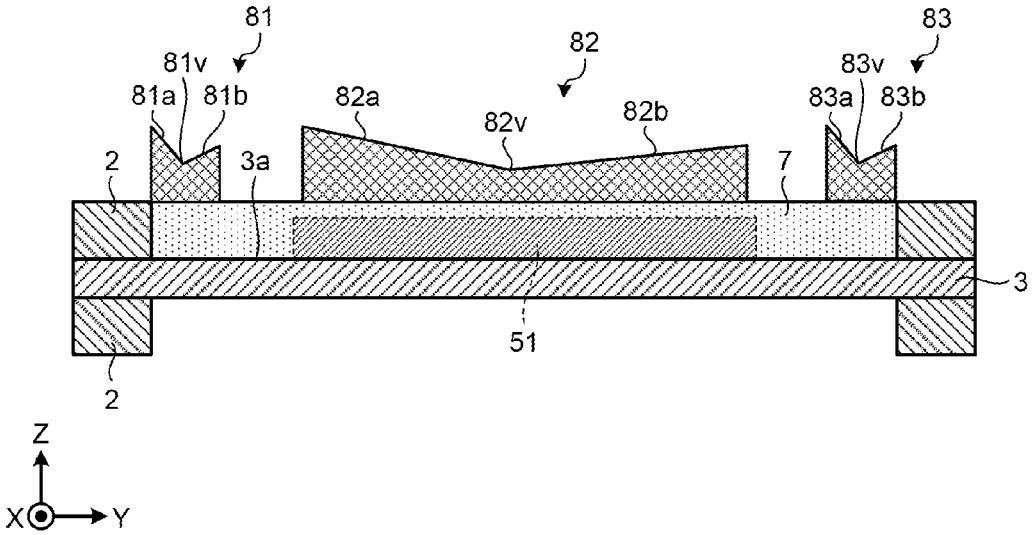
FIG. 7 is an enlarged cross-sectional view illustrating an arrangement example of other damping members in the acoustic generator in the embodiment cut along line A-A' in FIG. 4A.

In the embodiment as illustrated in FIG. 5 and FIG. 6, the thickness of the damping member 82 only in the Z-axis direction is non-uniform as an example. Alternatively, the thicknesses of the damping members 81, 82, and 83 in the Z-axis direction may be non-uniform. FIG. 7 is an enlarged cross-sectional view illustrating an arrangement example of other damping members in the acoustic generator 1 in the embodiment cut along line A-A' in FIG. 4A.

As illustrated in FIG. 7, the damping member 82 has an inclined surface 82*a* and an inclined surface 82*b*. The inclined surface 82*a* is inclined such that the thickness thereof in the Z-axis direction gradually decreases from an end portion at the negative side in the Y-axis direction toward a valley portion 82*v* formed on a center portion in the Y-axis direction. The inclined surface 82*b* is inclined such that the thickness thereof in the Z-axis direction gradually increases from the valley portion 82*v* toward an end portion at the positive side in the Y-axis direction.

In the same manner, the damping members 81 and 83 include inclined surfaces 81*a* and 83*a* and inclined surfaces 81*b* and 83*b*, respectively. The inclined surfaces 81*a* and 83*a* are inclined such that the thicknesses thereof in the Z-axis direction gradually decrease from end portions at the negative side in the Y-axis direction toward valley portions 81*v* and 83*v* formed on center portions in the Y-axis direction, respectively. The inclined surfaces 81*b* and 83*b* are inclined such that the thicknesses thereof in the Z-axis direction gradually increase from the valley portions 81*v* and 83*v* to end portions at the positive side in the Y-axis direction, respectively.

Thus, in the acoustic generator 1 in the embodiment, all of the damping members 81, 82, and 83 are formed to have such shapes that the thicknesses thereof in the Z-axis direction are larger on outer portions than on inner portions in the Y-axis direction, what is called recessed cross sections. With this configuration, the frequency at which the damping effect is the largest varies, so that the damping effect is enhanced for a long-period vibration mode particularly. This can reduce the difference between the resonance peaks and the dips in the frequency characteristic of the sound pressure so as to improve sound quality for low-pitched sounds particularly.

Although all of the damping members 81, 82, and 83 are formed to have V-shaped cross sections in FIG. 7, they are not limited thereto and may have U-shaped cross sections or arc shapes, for example.

Figure 8:
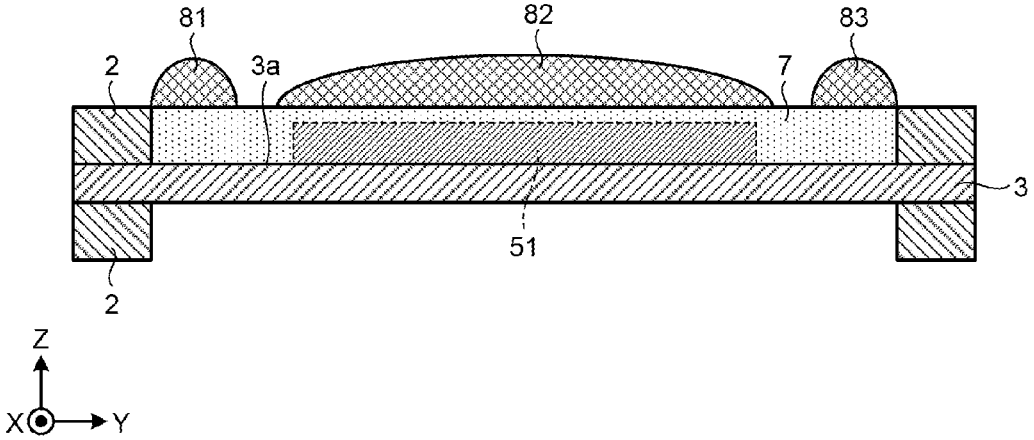
FIG. 8 is an enlarged cross-sectional view illustrating an arrangement example of other damping members in the acoustic generator in the embodiment cut along line A-A' in FIG. 4A.

FIG. 8 is an enlarged cross-sectional view illustrating an arrangement example of other damping members in the acoustic generator 1 in the embodiment cut along line A-A' in FIG. 4A.

As illustrated in FIG. 8, all of the damping members 81, 82, and 83 are formed to have such shapes that the thicknesses thereof in the Z-axis direction are smaller on outer portions than on inner portions in the Y-axis direction, what is called projecting cross sections. With this configuration, the frequency at which the damping effect is the largest varies, so that the damping effect is enhanced for a short-period vibration mode particularly. This can reduce the difference between the resonance peaks and the dips in the frequency characteristic of the sound pressure so as to improve sound quality for high-pitched sounds particularly.

Although all of the damping members 81, 82, and 83 are formed to have arc-shaped cross sections or bowl-shaped cross sections in FIG. 8, they are not limited thereto and may have A-shaped cross sections (inverted V-shaped cross sections), for example.

Figure 9:
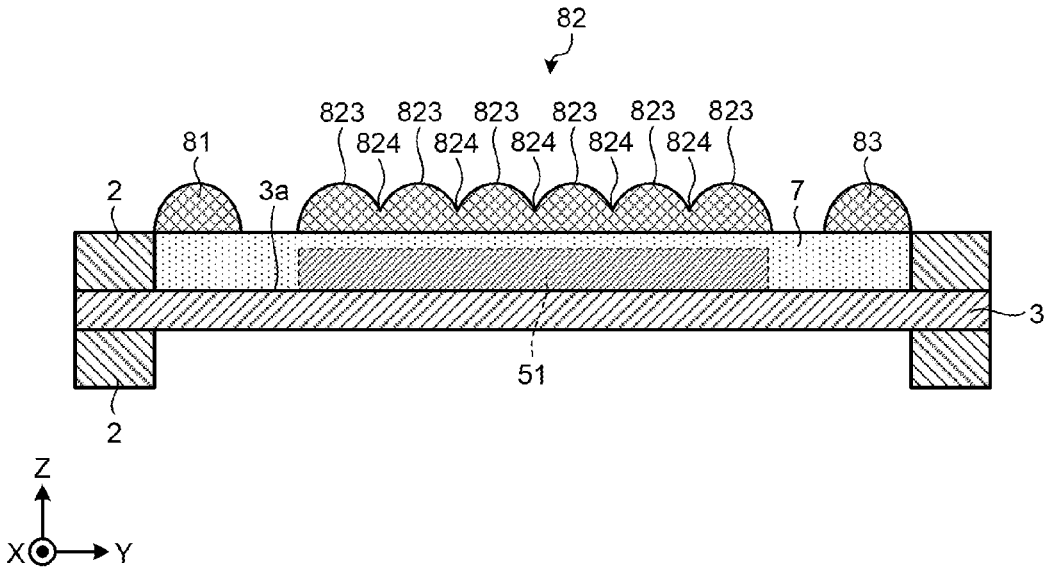
FIG. 9 is an enlarged cross-sectional view illustrating an arrangement example of other damping members in the acoustic generator in the embodiment cut along line A-A' in FIG. 4A.

FIG. 9 is an enlarged cross-sectional view illustrating an arrangement example of other damping members in the acoustic generator 1 in the embodiment cut along line A-A' in FIG. 4A.

As illustrated in FIG. 9, both of the damping members 81 and 83 have shapes that are substantially the same as those of the damping members 81 and 83 as illustrated in FIG. 8. On the other hand, the damping member 82 has projections 823 and recesses 824 having the thicknesses smaller than those of the projections 823 in the Z-axis direction. The projections 823 and the recesses 824 are alternately arranged in the Y-axis direction (direction along the vibration surface).

Thus, in the acoustic generator 1 in the embodiment, the damping member 82 has both the projections 823 and the recesses 824 and the surface thereof has irregularities in the Y-axis direction. With this configuration, the frequency at which the damping effect is the largest varies, so that the damping effect is enhanced for a vibration mode over a wide frequency region. This can reduce the difference between the resonance peaks and the dips in the frequency characteristic of the sound pressure so as to improve sound quality over a wide frequency range for music with complicated frequencies mixed, for example.

Although the damping member 82 has a cross-sectional shape like that formed by aligning the damping members 81 and/or 83 as illustrated in FIG. 8 in the Y-axis direction in FIG. 9, the damping member 82 is not limited to have this shape and may have a shape like that formed by aligning the damping members 81 and/or 83 as illustrated in FIG. 7 in the Y-axis direction.

Although at least one of the damping members 81, 82, and 83 has the different thickness distribution in the Z-axis direction in each of the above-mentioned embodiments, the embodiments are not limited thereto. For example, it is sufficient that at least one of the damping members 81, 82, 83, 84, and 85 as illustrated in FIG. 4A has the different thickness distribution in the Z-axis direction. For example, as illustrated in FIG. 10, the thickness of at least one of the damping members arranged on a plurality of areas in the Z-axis direction may be different from the thicknesses of the other damping members in the Z-axis direction and the damping members may have a non-uniform configuration as a whole.

Figure 10:
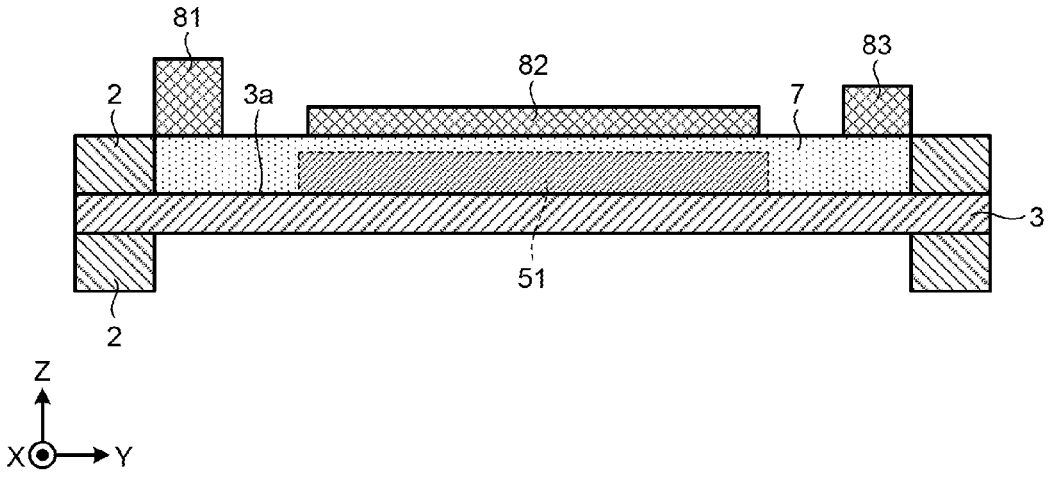
FIG. 10 is an enlarged cross-sectional view illustrating an arrangement example of other damping members in the acoustic generator in the embodiment cut along line A-A' in FIG. 4A.

FIG. 10 is an enlarged cross-sectional view illustrating an arrangement example of other damping members in the acoustic generator 1 in the embodiment cut along line A-A' in FIG. 4A.

As illustrated in FIG. 10, the damping members 81, 82, and 83 have thicknesses in the Z-axis direction that are different from one another. In the acoustic generator 1 in the embodiment, the damping members 81, 82, and 83 having different thicknesses in the Z-axis direction cause the frequency at which the damping effect is the largest to vary, so that the damping effect is enhanced. This can reduce the difference between the resonance peaks and the dips in the frequency characteristic of the sound pressure so as to improve sound quality.

Although the damping members 81, 82, and 83 have the thicknesses in the Z-axis direction that are different from one another in the above-mentioned embodiment, the embodiment is not limited thereto. For example, it is sufficient that at least one of the damping members 81, 82, 83, 84, and 85 as illustrated in FIG. 4A has a different thickness in the Z-axis direction.

Figure 11A:
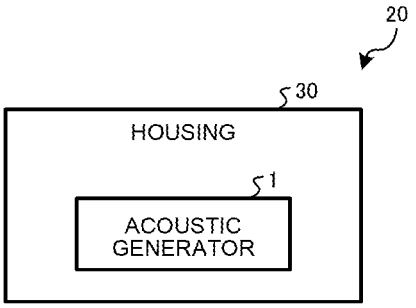
FIG. 11A is a diagram illustrating the configuration of an acoustic generating device according to another embodiment.
Figure 11B:
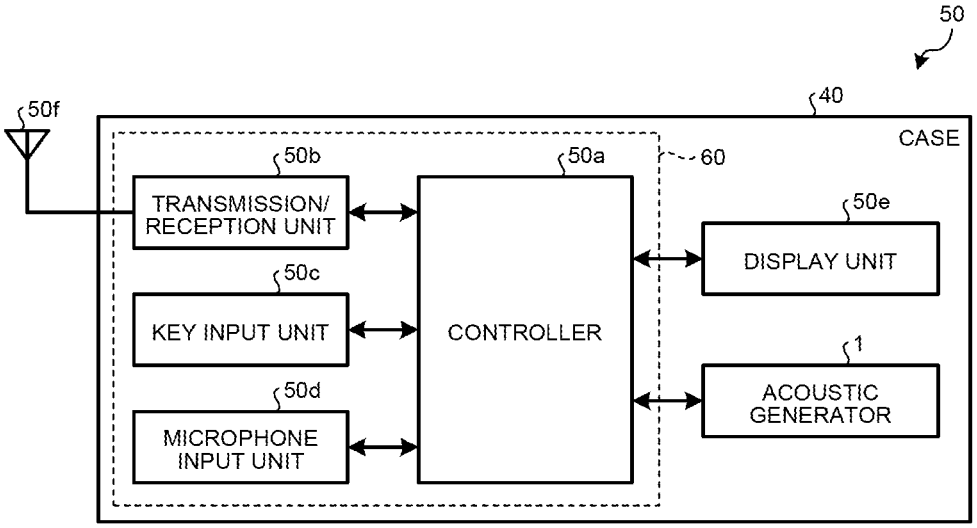
FIG. 11B is a diagram illustrating the configuration of an electronic device according to still another embodiment.

The following describes an acoustic generating device and an electronic device on which the acoustic generator 1 according to the embodiment as described above is mounted are described with reference to FIG. 11A and FIG. 11B. FIG. 11A is a diagram illustrating the configuration of an acoustic generating device 20 according to another embodiment, and FIG. 11B is a diagram illustrating the configuration of an electronic device 50 according to still another embodiment. Both of the drawings illustrate constituent components necessary for explanation only and omit illustration of common constituent components.

The acoustic generating device 20 is an acoustic generating device such as what is called a speaker, and includes the acoustic generator 1 and a housing 30 accommodating the acoustic generator 1 as illustrated in FIG. 11A. The housing 30 resonates therein sound generated by the acoustic generator 1 and outputs the sound to the outside through an opening (not illustrated) formed on the housing 30. The acoustic generating device 20 includes the housing 30 so as to increase the sound pressure in a low-frequency band, for example.

The acoustic generator 1 can be mounted on the electronic device 50 of various types. For example, in FIG. 11B, the electronic device 50 is assumed to be a mobile terminal apparatus such as a mobile phone and a tablet terminal.

As illustrated in FIG. 11B, the electronic device 50 includes an electronic circuit 60. The electronic circuit 60 is constituted by a controller 50*a*, a transmission/reception unit 50*b*, a key input unit 50*c*, and a microphone input unit 50*d*, for example. The electronic circuit 60 is connected to the acoustic generator 1 and has a function of outputting an audio signal to the acoustic generator 1. The acoustic generator 1 generates sound based on the audio signal input from the electronic circuit 60.

The electronic device 50 includes a display unit 50*e*, an antenna 50*f*, and the acoustic generator 1. The electronic device 50 includes a case 40 accommodating the devices.

Although FIG. 11B illustrates a state where all the devices including the controller 50*a* are accommodated in the one case 40, this does not limit an accommodation form of the devices. In the embodiment, it is sufficient that the one case 40 accommodates at least the electronic circuit 60 and the acoustic generator 1.

The controller 50*a* is a controller of the electronic device 50. The transmission/reception unit 50*b* transmits and receives data through the antenna 50*f* based on control by the controller 50*a*.

The key input unit 50*c* is an input device of the electronic device 50 and receives a key input operation by an operator. The microphone input unit 50*d* is also an input device of the electronic device 50 and receives an audio input operation and the like by the operator.

The display unit 50*e* is a display output device of the electronic device 50 and outputs display information based on control by the controller 50*a*.

The acoustic generator 1 operates as an acoustic output device in the electronic device 50. The acoustic generator 1 is connected to the controller 50*a* of the electronic circuit 60 and receives application of a voltage controlled by the controller 50*a* so as to generate sound.

Although the electronic device 50 is assumed to be the mobile terminal apparatus in FIG. 11B, it does not limit the type of the electronic device 50 and the electronic device 50 may be applied to various consumer apparatuses having a function of generating sound. For example, it is needless to say that the electronic device 50 may be used for a thin-screen television and a car audio system. In addition, the electronic device 50 may be also used for products having a function of generating sound including "speaking". Examples thereof include various products such as cleaners, washers, refrigerators, and microwaves.

As described above, the acoustic generator in the embodiment includes the exciter (piezoelectric element), the vibrating body, and the damping member. The exciter receives input of an electric signal and vibrates. The exciter is attached to the vibrating body, and the vibrating body vibrates together with the exciter with the vibration of the exciter. The damping member is formed to have a non-uniform thickness in the vibration direction orthogonal to the vibration surface of the vibrating body.

Accordingly, the acoustic generator in the embodiment can provide a preferable frequency characteristic of the sound pressure.

Although the inner region of the frame body has the substantially rectangular shape and it is sufficient that it has a polygonal shape in the above-mentioned embodiment, the shape of the inner region of the frame body is not limited thereto. The inner region of the frame body may have a circular shape or an elliptical shape.

Although the damping member is attached to the surface of the resin layer when the resin layer is formed in the above-mentioned embodiment, the damping member may be attached to a portion (for example, the surface of the vibrating body at the side on which the resin layer is not formed) on which the resin layer is not formed when the resin layer is formed.

Furthermore, although the resin layer is formed in the frame of the frame body so as to cover the piezoelectric element and the vibrating body, the resin layer may not be necessarily formed. Even in such a case, an arrangement manner of the damping member is not restricted as long as the damping member can be attached integrally with the vibrating body and the exciter. For example, the damping member may be attached to a lower surface 3*b* of the vibrating body 3*a* illustrated in FIG. 3A.

Although the vibration plate is formed by a thin film such as the resin film as an example in the above-mentioned embodiment, the embodiment is not limited thereto. For example, the vibration plate may be formed by a plate-like member.

Although the support member supporting the vibrating body is the frame body and the frame body supports the peripheral edge of the vibrating body in the above-mentioned embodiment, the embodiment is not limited thereto. For example, the frame body may support only both the ends of the vibrating body in the lengthwise direction or the short-side direction.

Furthermore, although the piezoelectric element 5 is arranged on the same plane as the upper surface or the lower surface of the vibrating body 3*a* in FIG. 4A to FIG. 10, the piezoelectric elements 5 may be arranged on both of the upper surface and the lower surface. In addition, although the piezoelectric element 5 is arranged at the substantial center of the vibration surface of the vibrating body 3*a*, the piezoelectric element 5 may be arranged at a position deviated from the center of the vibration surface of the vibrating body 3*a*.

Although the exciter is formed by the piezoelectric element as an example in the above-mentioned embodiment, the exciter is not limited to the piezoelectric element. Any exciter having a function of receiving input of an electric signal and vibrating may be used.

For example, an electrodynamic exciter, an electrostatic exciter, and an electromagnetic exciter that have been known as exciters vibrating a speaker may be used.

The electrodynamic exciter applies an electric current to a coil arranged between magnetic poles of a permanent magnet to vibrate the coil. The electrostatic exciter applies a bias and an electric signal to two opposing metal plates to vibrate the metal plates. The electromagnetic exciter applies an electric signal to a coil to vibrate a thin iron sheet.

Additional effects and variations can be easily derived by those skilled in the art. A wider aspect of the invention is not limited by specific details and representative embodiments that have been expressed and described above. Accordingly, various changes can be made without departing from the spirit or scope of the general concept of the invention defined by the scope of the invention and equivalents thereof.

The invention claimed is:

1. An acoustic generator comprising:

an exciter that receives input of an electric signal and vibrates;

a vibrating body to which the exciter is attached and that vibrates together with the exciter with vibration of the exciter;

a resin layer that is provided so as to embed the exciter therein and cover at least a part of a surface of the vibrating body; and a damping member that is attached to a surface of the resin layer and has a non-uniform thickness in a direction orthogonal to a vibration surface of the vibrating body, wherein the damping member is provided in an area in which the damping member overlaps with at least the exciter when viewing from the direction orthogonal to the vibration surface of the vibrating body.

2. The acoustic generator according to claim 1, wherein the damping member includes a first portion and a second portion that have different thicknesses in the direction orthogonal to the vibration surface, and the first portion and the second portion are arranged with a step interposed between the first portion and the second portion.

3. The acoustic generator according to claim 1, wherein the damping member has an inclined surface inclined with respect to the vibration surface.

4. The acoustic generator according to claim 1, wherein the damping member has a thickness of a center portion in a direction along the vibration surface in the direction orthogonal to the vibration surface smaller than a thickness of an outer portion at an outer side relative to the center portion in the direction orthogonal to the vibration surface.

5. The acoustic generator according to claim 1, wherein the damping member has a thickness of a center portion in a direction along the vibration surface in the direction orthogonal to the vibration surface larger than a thickness of an outer portion at an outer side relative to the center portion in the direction orthogonal to the vibration surface.

6. The acoustic generator according to claim 1, wherein the damping member comprises a projection and a recess having a thickness smaller than a thickness of the projection in the direction orthogonal to the vibration surface, and the projection and the recess are arranged in the direction along the vibration surface.

7. The acoustic generator according to claim 1, wherein the exciter is a piezoelectric element.

8. The acoustic generator according to claim 1, wherein the exciter is a bimorph stacked piezoelectric element.

9. An acoustic generating device comprising:

the acoustic generator according to claim 1; and a housing that accommodates the acoustic generator.

10. An electronic device comprising:

the acoustic generator according to claim 1;

an electronic circuit that is connected to the acoustic generator; and a case that accommodates the electronic circuit and the acoustic generator, wherein the electronic device has a function of generating sound from the acoustic generator.

* * * * *